US008418623B2

(12) United States Patent
Lloyd

(10) Patent No.: US 8,418,623 B2
(45) Date of Patent: Apr. 16, 2013

(54) MULTI-POINT TIME SPACING KINETIC ENERGY ROD WARHEAD AND SYSTEM

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 333 days.

(21) Appl. No.: 12/798,426

(22) Filed: Apr. 2, 2010

(65) Prior Publication Data

US 2012/0192752 A1 Aug. 2, 2012

(51) Int. Cl.
*F42B 12/32* (2006.01)

(52) U.S. Cl.
USPC ..... 102/497

(58) Field of Classification Search ..... 102/494–497, 102/489
See application file for complete search history.

(56) References Cited

U.S. PATENT DOCUMENTS

| | | | |
|---|---|---|---|
| 1,198,035 | A | 9/1916 | Huntington |
| 1,229,421 | A | 6/1917 | Downs |
| 1,235,076 | A | 7/1917 | Stanton |
| 1,244,046 | A | 10/1917 | Ffrench |
| 1,300,333 | A | 4/1919 | Berry |
| 1,305,967 | A | 6/1919 | Hawks |
| 2,296,980 | A | 9/1942 | Carmichael |
| 2,308,683 | A | 1/1943 | Forbes |
| 2,322,624 | A | 6/1943 | Forbes |
| 2,337,765 | A | 12/1943 | Nahirney |
| 2,338,274 | A | 1/1944 | Yancey |
| 2,925,965 | A | 2/1960 | Pierce |
| 2,988,994 | A | 6/1961 | Fleischer, Jr. et al. |
| 3,081,703 | A | 3/1963 | Kamp et al. |
| 3,111,086 | A | 11/1963 | Alperstein |
| 3,332,348 | A | 7/1967 | Myers et al. |
| 3,464,356 | A | 9/1969 | Wasserman et al. |
| 3,565,009 | A | 2/1971 | Allred et al. |
| 3,656,433 | A | 4/1972 | Thrailkill et al. |
| 3,665,009 | A | 5/1972 | Dickinson, Jr. |
| 3,670,648 | A | 6/1972 | Cole et al. |
| 3,703,865 | A | 11/1972 | Gilbertson et al. |
| 3,757,964 | A | 9/1973 | Talley et al. |
| 3,771,455 | A | 11/1973 | Haas |
| 3,796,159 | A | 3/1974 | Conger |
| 3,797,359 | A | 3/1974 | Mawhinney et al. |

(Continued)

FOREIGN PATENT DOCUMENTS

| | | |
|---|---|---|
| DE | 3327043 A1 | 2/1985 |
| DE | 3722420 | 1/1989 |

(Continued)

OTHER PUBLICATIONS

Written Opinion of the International Searching Authority for International Application No. PCT/US2011/000563 mailed Dec. 6, 2011 (5 pages).

(Continued)

*Primary Examiner* — Michelle Clement
(74) *Attorney, Agent, or Firm* — Renner, Otto, Boisselle & Sklar, LLP

(57) ABSTRACT

A kinetic energy rod warhead includes a plurality of projectiles in a projectile core, explosive segments about the plurality of projectiles, and an isolator between adjacent explosive segments. There is an external detonator on an outer surface of each of the explosive segments proximate an isolator, and an internal detonator inside of each explosive segment adjacent the projectile core.

20 Claims, 6 Drawing Sheets

U.S. PATENT DOCUMENTS

| | | | |
|---|---|---|---|
| 3,818,833 | A | 6/1974 | Throner, Jr. |
| 3,846,878 | A | 11/1974 | Monson et al. |
| 3,851,590 | A | 12/1974 | LaCosta |
| 3,857,338 | A | 12/1974 | Bucklisch |
| 3,861,314 | A | 1/1975 | Barr |
| 3,877,376 | A | 4/1975 | Kupelian |
| 3,902,424 | A | 9/1975 | Dietsch et al. |
| 3,903,804 | A | 9/1975 | Luttrell et al. |
| 3,915,092 | A | 10/1975 | Monson et al. |
| 3,941,059 | A | 3/1976 | Cobb |
| 3,948,175 | A | 4/1976 | Bucklisch |
| 3,949,674 | A | 4/1976 | Talley |
| 3,954,060 | A | 5/1976 | Haag et al. |
| 3,977,330 | A | 8/1976 | Held |
| 4,015,527 | A | 4/1977 | Evans |
| 4,026,213 | A | 5/1977 | Kempton |
| 4,036,140 | A | 7/1977 | Korr et al. |
| 4,089,267 | A | 5/1978 | Mescall et al. |
| 4,106,410 | A | 8/1978 | Borcher et al. |
| 4,147,108 | A | 4/1979 | Gore et al. |
| 4,172,407 | A | 10/1979 | Wentink |
| 4,210,082 | A | 7/1980 | Brothers |
| 4,211,169 | A | 7/1980 | Brothers |
| 4,216,720 | A | 8/1980 | Kempton |
| 4,231,293 | A | 11/1980 | Dahn et al. |
| 4,289,073 | A | 9/1981 | Romer et al. |
| 4,353,305 | A | 10/1982 | Moreau et al. |
| 4,376,901 | A | 3/1983 | Pettibone et al. |
| 4,430,941 | A | 2/1984 | Raech, Jr. et al. |
| 4,455,943 | A | 6/1984 | Pinson |
| 4,459,915 | A | 7/1984 | Lynch |
| 4,516,501 | A | 5/1985 | Held et al. |
| 4,538,519 | A | 9/1985 | Witt et al. |
| 4,638,737 | A | 1/1987 | McIngvale |
| 4,648,323 | A | 3/1987 | Lawther |
| 4,655,139 | A | 4/1987 | Wilhelm |
| 4,658,727 | A | 4/1987 | Wilhelm et al. |
| 4,676,167 | A | 6/1987 | Huber et al. |
| 4,729,321 | A | 3/1988 | Stafford |
| 4,745,864 | A | 5/1988 | Craddock |
| 4,760,793 | A | 8/1988 | Herring, III et al. |
| 4,770,101 | A | 9/1988 | Robertson et al. |
| 4,777,882 | A | 10/1988 | Dieval |
| 4,848,239 | A | 7/1989 | Wilhelm |
| 4,872,409 | A | 10/1989 | Becker et al. |
| 4,922,826 | A | 5/1990 | Busch et al. |
| 4,957,046 | A | 9/1990 | Puttock |
| 4,978,088 | A | 12/1990 | Himmert et al. |
| 4,995,573 | A | 2/1991 | Wallow |
| 4,996,923 | A | 3/1991 | Theising |
| 5,020,436 | A | 6/1991 | Coburn |
| H1047 | H | 5/1992 | Henderson et al. |
| H1048 | H | 5/1992 | Wilson et al. |
| 5,117,759 | A | 6/1992 | Henderson et al. |
| 5,182,418 | A | 1/1993 | Talley |
| 5,223,667 | A | 6/1993 | Anderson |
| 5,229,542 | A | 7/1993 | Bryan et al. |
| 5,313,890 | A | 5/1994 | Cuadros |
| 5,359,935 | A | 11/1994 | Willett |
| 5,370,053 | A | 12/1994 | Williams et al. |
| 5,498,160 | A | 3/1996 | Farina et al. |
| 5,524,524 | A | 6/1996 | Richards et al. |
| 5,535,679 | A | 7/1996 | Craddock |
| 5,542,354 | A | 8/1996 | Sigler |
| 5,544,589 | A | 8/1996 | Held |
| 5,577,431 | A | 11/1996 | Kusters |
| 5,578,783 | A | 11/1996 | Brandeis |
| 5,583,311 | A | 12/1996 | Rieger |
| 5,622,335 | A | 4/1997 | Trouillot et al. |
| D380,784 | S | 7/1997 | Smith |
| 5,670,735 | A | 9/1997 | Ortmann et al. |
| 5,691,502 | A | 11/1997 | Craddock et al. |
| 5,796,031 | A | 8/1998 | Sigler |
| 5,823,469 | A | 10/1998 | Arkhangelsky et al. |
| 5,929,370 | A | 7/1999 | Brown et al. |
| 5,936,191 | A | 8/1999 | Bisping et al. |
| 6,010,580 | A | 1/2000 | Dandliker et al. |
| 6,035,501 | A | 3/2000 | Bisping et al. |
| 6,044,765 | A | 4/2000 | Regebro |
| 6,073,880 | A | 6/2000 | Voigt et al. |
| 6,186,070 | B1 | 2/2001 | Fong et al. |
| 6,223,658 | B1 | 5/2001 | Rosa et al. |
| 6,240,849 | B1 | 6/2001 | Holler |
| 6,276,277 | B1 | 8/2001 | Schmacker |
| 6,279,478 | B1 | 8/2001 | Ringer et al. |
| 6,279,482 | B1 | 8/2001 | Smith et al. |
| 6,598,534 | B2 | 7/2003 | Lloyd et al. |
| 6,622,632 | B1 | 9/2003 | Spivak |
| 6,640,723 | B2 | 11/2003 | Spivak et al. |
| 6,666,145 | B1 | 12/2003 | Nardone et al. |
| 6,779,462 | B2 | 8/2004 | Lloyd |
| 6,910,423 | B2 | 6/2005 | Lloyd |
| 6,920,827 | B2 | 7/2005 | Llyod |
| 6,931,994 | B2 | 8/2005 | Lloyd |
| 6,973,878 | B2 | 12/2005 | Lloyd et al. |
| 6,978,967 | B1 | 12/2005 | Scheper et al. |
| 7,017,496 | B2 | 3/2006 | Lloyd |
| 7,040,235 | B1 | 5/2006 | Lloyd |
| 7,143,698 | B2 | 12/2006 | Lloyd |
| 7,415,917 | B2 | 8/2008 | Lloyd |
| 7,621,222 | B2 | 11/2009 | Lloyd |
| 7,624,682 | B2 | 12/2009 | Lloyd |
| 7,624,683 | B2 | 12/2009 | Lloyd |
| 2003/0019386 | A1 | 1/2003 | Lloyd et al. |
| 2003/0029347 | A1 | 2/2003 | Lloyd |
| 2004/0011238 | A1 | 1/2004 | Ronn et al. |
| 2004/0055498 | A1 | 3/2004 | Lloyd |
| 2004/0055500 | A1 | 3/2004 | Lloyd et al. |
| 2004/0129162 | A1 | 7/2004 | Lloyd |
| 2004/0200380 | A1 | 10/2004 | Lloyd |
| 2005/0016372 | A1 | 1/2005 | Kilvert |
| 2005/0109234 | A1 | 5/2005 | Lloyd |
| 2005/0115450 | A1 | 6/2005 | Lloyd |
| 2005/0223930 | A1 | 10/2005 | Bootes et al. |
| 2006/0086279 | A1* | 4/2006 | Lloyd ..... 102/497 |
| 2006/0112847 | A1 | 6/2006 | Lloyd |
| 2006/0283348 | A1 | 12/2006 | Lloyd |
| 2007/0084376 | A1 | 4/2007 | Lloyd |

FOREIGN PATENT DOCUMENTS

| | | | |
|---|---|---|---|
| DE | 3735426 | | 5/1989 |
| DE | 38305027 | A1 | 3/1990 |
| DE | 3834367 | | 4/1990 |
| DE | 3934042 | A1 | 4/1991 |
| DE | 195 24 726 | | 2/1996 |
| EP | 270 401 | A1 | 6/1988 |
| EP | 872705 | | 10/1998 |
| EP | 902250 | | 3/1999 |
| FR | 2678723 | A1 | 1/1993 |
| FR | 2695467 | | 3/1994 |
| GB | 550001 | | 12/1942 |
| GB | 2236581 | | 4/1991 |
| JP | 6386595 | | 6/1988 |
| JP | 1-296100 | | 11/1989 |
| JP | 06213599 | A | 8/1994 |
| RU | 2249175 | | 3/2005 |
| WO | WO 97/27447 | | 7/1997 |
| WO | WO 99/30966 | | 6/1999 |
| WO | WO0214780 | A1 | 2/2002 |

OTHER PUBLICATIONS

FAS Military Analysis Network (http://www.fas.org/man/dod-101/sys/land/bullets2.htm): Big Bullets for Beginners, Feb. 6, 2000. (13 pages).

FAS Military Analysis Network (http://www.fas.org/man/dod-101/sys/land/m546.htm): M546 APERS-T 105-mm, Jan. 21, 1999. (1 page).

Richard M. Lloyd, "Aligned Rod Lethality Enhancement Concept for Kill Vehicles," AIAA/BMDD Technology Conf., Jun. 5, Maastricht, Netherlands, 2001: pp. 1-12.

Richard M. Lloyd, "Aligned Rod Lethality Enhancement Concept for Kill Vehicles." AIAA/BMDD Technology Conf., Jul. 23-26, Williamsburg, Virginia, 2001: pp. 1-12.

Richard M. Lloyd, "Conventional Warhead Systems Physics and Engineering Design," vol. 179, Progress in Astronautics and Aeronautics, Copyright 1998 by the American Institute of Aeronautics and Astronautics, Inc., Chapter 5, pp. 1-251.
Richard M. Lloyd, "Physics of Direct Hit and Near Miss Warhead Technology," vol. 194, Progress in Astronautics and Aeronautics, Copyright 2001 by the American Institute of Aeronautics and Astronautics, Inc., Chapter 3, pp. 99-197.
Richard M. Lloyd, "Physics of Direct Hit and Near Miss Warhead Technology," vol. 194, Progress in Astronautics and Aeronautics, Copyright 2001 by the American Institute of Aeronautics and Astronautics, Inc., Chapter 6, pp. 311-406.

* cited by examiner

MULTI-POINT TIME SPACING KINETIC ENERGY ROD WARHEAD AND SYSTEM

FIELD OF THE INVENTION

This subject invention relates to improvements in kinetic energy rod warheads.

BACKGROUND OF THE INVENTION

Destroying missiles such as tactical ballistic missiles, airborne targets such as cruise missiles, aircraft, re-entry vehicles, and other targets falls into three primary classifications: "hit-to-kill" vehicles, blast fragmentation warheads, and kinetic energy rod warheads.

"Hit-to-kill" vehicles are typically launched into a position proximate a target via a missile such as the Patriot, Trident or MX missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some "hit-to-kill" threats, and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the target and, again, biological bomblets and/or chemical submunition payloads may survive and cause heavy casualties.

A kinetic energy rod warhead has at least two primary advantages over "hit-to-kill vehicles" and blast fragmentation warheads. A kinetic energy rod warhead does not rely on precise navigation as is the case with "hit-to-kill" vehicles. Also, a kinetic energy rod warhead provides better penetration than blast fragmentation type warheads.

The primary components typically associated with a theoretical kinetic energy rod warhead are a projectile core or bay including a number of individual lengthy rod projectiles or penetrators, and an explosive charge. When the explosive charge is detonated, the rod projectiles or penetrators are deployed. Typically, these components are within a hull or housing.

The inventor hereof, Richard M. Lloyd, has published several textbooks concerning kinetic energy rod warheads, and including some discussions of "hit-to-kill" vehicles and blast fragmentation type warheads, and has been granted a number of patents for kinetic energy warheads and/or kinetic energy rod warhead technology, including U.S. Pat. Nos. 6,598,534; 6,779,462; 6,931,994; 7,040,235; 7,415,917; 7,017,496; 6,973,878; 6,910,423; 6,920,827; 7,624,682; 7,621,222; 7,624,683; and 7,143,698. The inventor hereof also has various pending patent applications concerning kinetic energy rod warheads and kinetic energy rod warhead technology, including U.S. Pat. Publ. Nos. 20060112847; 20070084376; and 20060283348.

Greater lethality is achieved when the projectiles or rods of a kinetic energy rod warhead are deployed to intercept and/or destroy a target. Some methods for aiming of fragments or projectiles is disclosed in various patents by others for various types of warheads or ordnance systems, including U.S. Pat. Nos. 4,026,213; 3,703,865; 3,757,694; 3,796,159; 2,925,965; and 4,216,720, and German patent publication number DE19524726. For the most part, however, these patents do not take into consideration the countervailing considerations of weight, explosive sections, and/or hardware configurations that must be accounted for in a kinetic energy rod warhead.

In order to aim and deploy the projectiles or rods of a kinetic energy rod warhead, the explosive charge is typically divided into a number of explosive charge segments or sections, with sympathetic shields between the segments. Each explosive segment may have its own detonator. Selected explosive charge segments are detonated to aim the projectiles in a specific direction and to control the spray pattern of the projectiles. For instance, detonators, detonator cords and/or jettison packs on one side of the projectile core can be detonated to cause their associated explosive charge segments to eject specified hull sections, creating an opening in the hull on the target side. Detonators on the opposite side of the core are detonated to deploy the projectile rods in the direction of the opening and thus towards the target. See e.g. U.S. Pat. Nos. 6,598,534 and 6,973,878 which are incorporated herein by reference.

A kinetic energy warhead including the foregoing design may be highly effective, but the exact position of the target in relation to the warhead explosive charge segments may affect aiming accuracy. The target may be positioned relative to the warhead such that the center of the rod set does not travel close to the target direction, which could result in aiming errors. For example, the target may be in a position where deploying one set of explosive segments, i.e. three adjacent segments, will result in the center of the rod core travelling in a direction which is not the target direction, but where deploying a different set of explosive segments, i.e. four adjacent segments, still may not direct the rods towards the target as desired. Additionally, the number of explosive segments detonated will affect the total spray pattern diameter, which may be critical in some applications.

To reduce potential aiming errors, explosive charge segments of a conventional kinetic energy rod warhead may be deployed in combinations to drive the rods in a specific deployment direction to more accurately strike a target, overcoming restrictions resulting from some hardware configurations. See e.g. U.S. Pat. Publ. No. 20070084376 which is incorporated herein by reference.

Even with such designs, however, hardware constraints may still inhibit the effectiveness of the kinetic energy rod warhead. In some cases, for example, the isolators or shields which divide the explosive into sections may interrupt explosive shock waves, and/or cause a decrease in the surface area of the explosive segments resulting in less available surface area for the shock waves to build. Moreover, it would be desirable to deploy an increased number of projectile rods towards a target for greater efficiency and lethality and/or to reduce the overall weight of the kinetic energy rod warhead.

BRIEF SUMMARY OF THE INVENTION

Embodiments of the invention provide an improved kinetic energy rod warhead with increased efficiency and lethality. In one aspect, the applicant's kinetic energy rod warhead utilizes a reduced number of explosive segments or sections, and in one example, the number and placement of explosive initiators is optimized. The result is more explosive surface area per section, less interruption of explosive shock waves, better control over the shock waves, better aiming accuracy, and/or increased space available for more rods or projectiles.

The invention results from the realization, in part, that a kinetic energy rod warhead with enhanced aiming resolution and lethality can be achieved with less explosive sections and with initiators positioned both external to and at the interior of the explosive, and/or at points proximate isolators which are disposed between explosive segments.

The invention thus provides an improved way to destroy a target, and may be used exclusively, or in conjunction with many of the warhead configurations and/or features for destroying targets disclosed in the applicant's other patents or patent applications such as those enumerated above, and/or may include other features as desired for a particular application.

The embodiments of the invention, however, need not achieve all these results or objectives and the claims hereof should not be limited to structures or methods capable of achieving these results or objectives.

The invention features a kinetic energy rod warhead including a plurality of projectiles in a projectile core, explosive segments about the plurality of projectiles, and an isolator between adjacent explosive segments. An external detonator is on an outer surface of each of the explosive segments proximate an isolator, and an internal detonator is inside of each explosive segment adjacent the projectile core. In one variation, there are at least two external detonators for each explosive segment, and each isolator includes at least one of the external detonators located on each side thereof. The internal detonators are typically located centrally between two isolators. In one embodiment, there are at most four explosive segments, or at most four isolators. In one configuration, a target locator system is configured to locate a target relative to an isolator, or relative to an explosive segment, and a controller, responsive to the target locator system, is configured to selectively detonate specified detonators or sets of detonators in sequence depending on the desired deployment direction of the projectiles. In one example, the projectiles are rods, such as lengthy metallic members, which may have a cylindrical cross-section. Also in such an example the isolators are typically sympathetic shields. In one variation, the explosive segments are wedge-shaped, and a housing surrounds the explosive segments.

The invention also features a kinetic energy rod warhead including a plurality of projectile rods in a projectile core, and an explosive surrounding the plurality of projectile rods. Sympathetic shields divide the explosive into at most four segments. An internal detonator is located centrally inside of each explosive segment adjacent the projectile core, and there is an external detonator on an outer surface of each of the explosive segments, each sympathetic shield including one external detonator on each side thereof.

This invention further features a kinetic energy rod warhead system including a plurality of projectiles in a projectile core, and explosive segments surrounding the plurality of projectiles, and an isolator between adjacent explosive segments. There is an external detonator on an outer surface of each of said explosive segments proximate an isolator, and an internal detonator inside of each explosive segment adjacent the projectile core. A target locator system is configured to locate a target relative to the isolators or the explosive segments and a controller, responsive to the target locator system, is configured to selectively detonate specified detonators or sets of detonators in sequence depending on the desired deployment direction of the projectiles. In one aspect, there are at most four explosive segments. In another aspect, each isolator includes at least one external detonator located on each side thereof, and in another aspect, the internal detonators are located centrally between two isolators.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
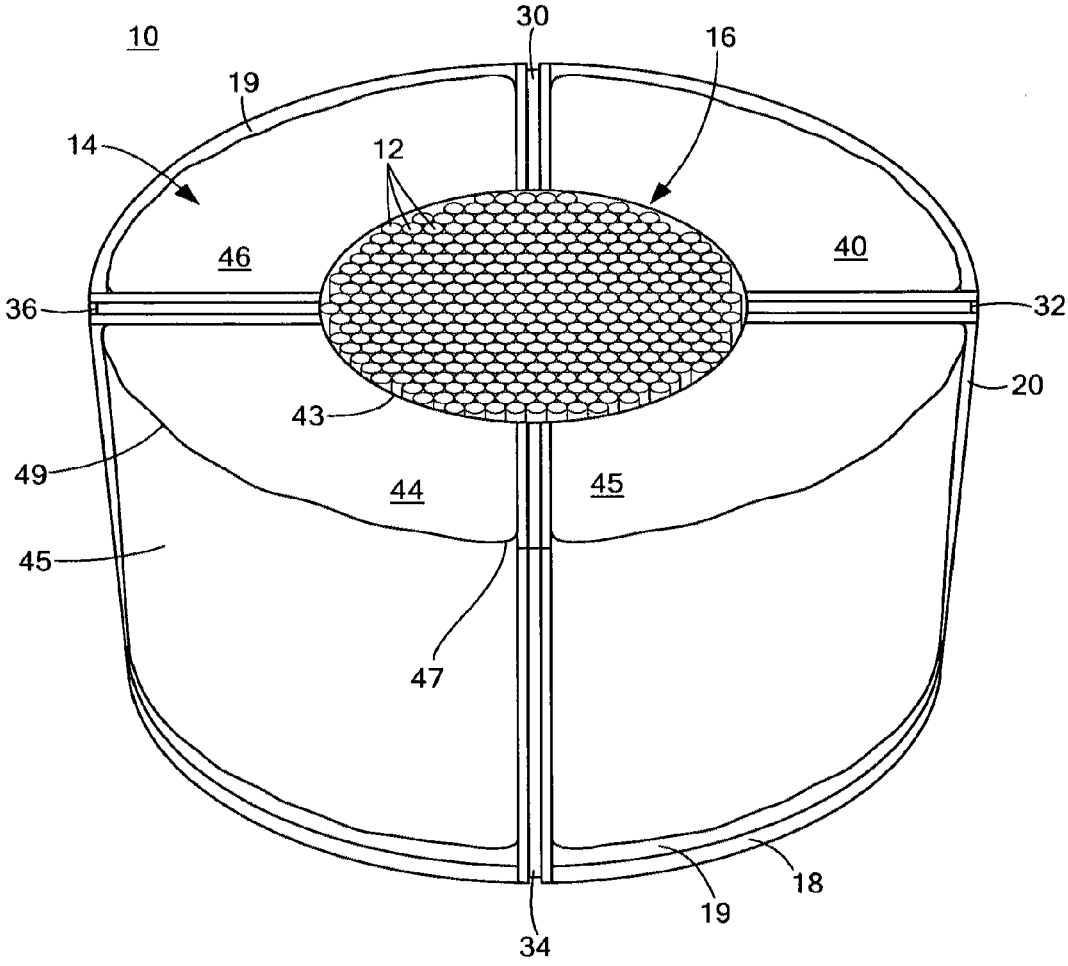
FIG. 1 is a schematic, partial three-dimensional cutaway top view of an embodiment of a kinetic energy rod warhead in accordance with the invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Current kinetic energy rod warhead designs allow a plurality of rods to be aimed, but the hardware can impose some constraints on the aiming accuracy. The present invention provides, among other advantages, improved aiming resolution and better aiming accuracy despite such physical constraints.

A kinetic energy rod warhead and system in accordance with the invention includes kinetic energy rod warhead 10, FIG. 1 including plurality of projectiles 12, and explosive 14 about or surrounding the plurality of projectiles for deploying projectiles 12. Detonation of explosive 14 deploys projectiles 12.

Kinetic energy rod warhead 10 also includes projectile core 16, and typically includes end plates (only one of which is shown) 18, and absorbing layers 19 (one of which is shown) of thin aluminum, for example, although these are not necessary limitations. The explosive 14 and other internal components are generally disposed within hull or housing 20.

In one example of a typical known kinetic energy rod warhead, sympathetic shields divide the explosive charge into eight (8) individual sections disposed about the plurality of rods or projectiles. See e.g. U.S. Pat. Publ. No. 20070084376 incorporated herein by reference.

In one aspect of the invention, however, isolators 30, 32, 34 and 36, such as sympathetic shields, divide or separate explosive 14 into four segments 40, 42, 44 and 46, such that there is an isolator between adjacent explosive segments, such as isolator 30 between adjacent explosive sections 40 and 46. By decreasing the number of sections and sympathetic shields between sections to have four explosive sections at most, the overall weight of warhead 10 can be reduced. This decrease in weight allows for more projectile rods 12 to be added in projectile core 16. An additional number of projectile rods increases the likelihood that a target will be hit and destroyed.

Additionally, with a lesser number of sympathetic shields than were typically used previously, there are less explosive segments to interrupt explosive shock waves when explosive segments are detonated. Consequently, there is more explosive surface area to build up explosive shock waves.

Detonators or initiators were typically positioned optionally interiorly or exteriorly, typically in the center of each of the eight (8) explosive sections. Thus although effective, detonation and shock wave propagation was to some extent further limited.

In accordance with a further aspect of the invention, the number and positioning of detonators is configured to assist in providing better control over the shock waves and to increase efficiency overall.

Figure 2:
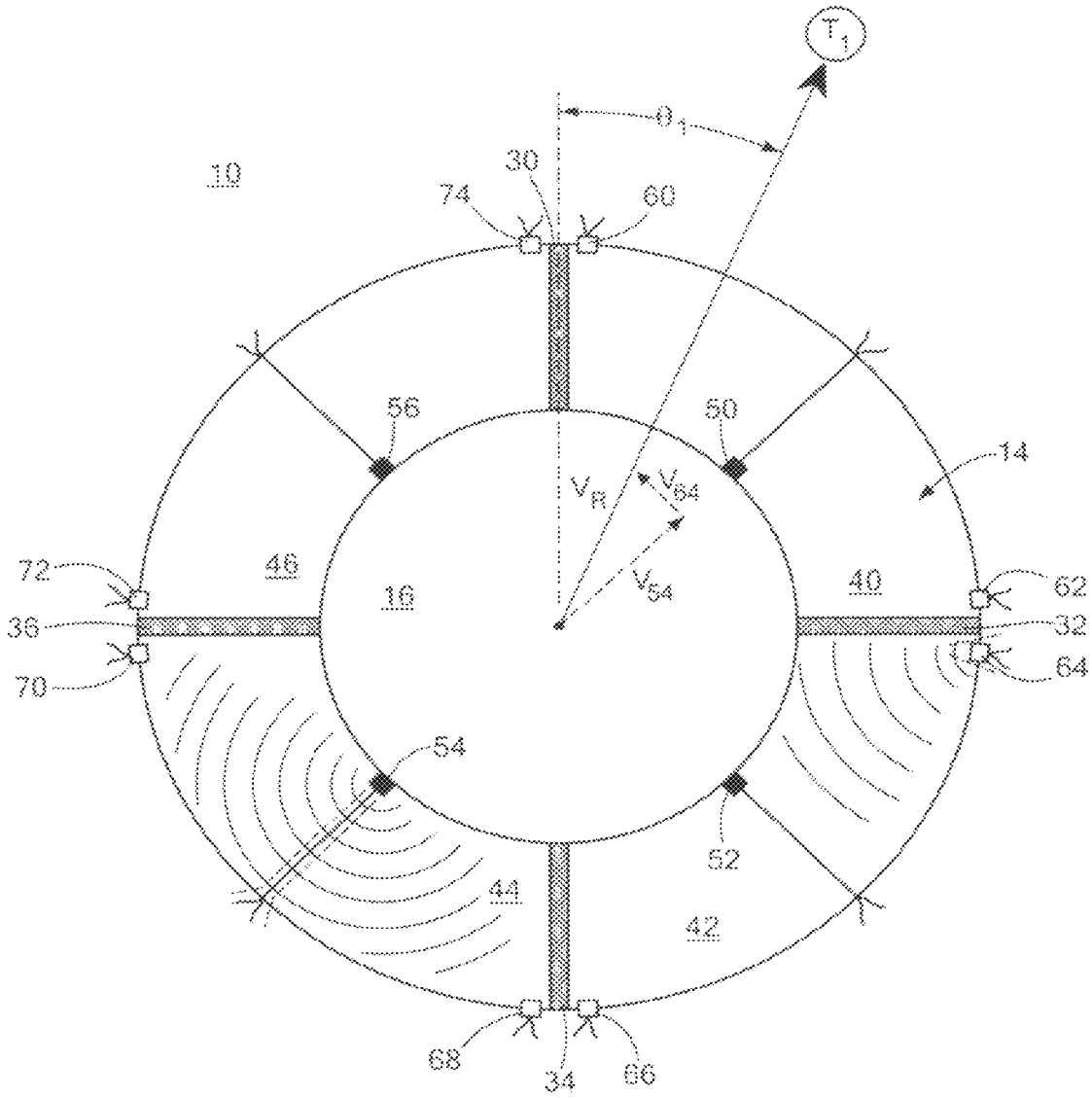
FIG. 2 is a schematic, cross-sectional top view of a kinetic energy rod warhead embodiment in accordance with the invention.

In one example, for each explosive segment 40, 42, 44 and 46, there are detonators 50, 52, 54, and 56, FIG. 2, respectively, located on the inside of the explosive segments, at or near an inside surface of the explosive segments adjacent projectile core 16. In one embodiment, internal detonators 50-56 are located centrally in the explosive segment between two isolators.

In addition, for each explosive segment 40, 42, 44 and 46, there is an external detonator on an outer surface of the explosive segment, proximate an isolator. For example, external detonator 60 is on an outer surface of explosive segment 40 proximate isolator 30. In one configuration, there are detonators 60 and 62, 64 and 66, 68 and 70, and 72 and 74, each located externally on or at an outer surface of the explosive segments proximate isolators or sympathetic shields 30, 32, 34 and 36. In one variation, each sympathetic shield includes at least one external detonator located on each side thereof. As shown in FIG. 2, detonator 62 is on one side of isolator 32, and detonator 64 is on the other side of isolator 32.

If a target $T_1$, FIG. 2, were located aligned at angle $\theta_1$ from a vertical angle measured from shield 30 of warhead 10, one way to achieve the deployment of projectiles from core 16 along a vector $V_R$ is to detonate internal detonator 54; then, simultaneously therewith or shortly thereafter (depending on the determination of the exact angle $\theta_1$) detonating external detonator 64. Detonator 64 is adjacent or proximate shield 32. When detonator 64 is fired, section 42 is exploded at an angle, rather than at its center. In this instance, external or outer detonator 64 creates a shock wave inwardly, supplying a "pushing" force and biasing the initial shock wave created by internal detonator 54. $V_R$, a resolved vector which is the sum of the vectors $V_{54}$ and $V_{64}$ created by detonation of detonators 54 and 64, respectively, is the ultimate direction of the center of the deployed plurality of rods or projectiles 12 within core 16.

Such multi-point time spacing and placement of detonators can more precisely deploy the rods at a target from the projectile core, and provide a narrower rod spray angle, if this latter consideration is important for a particular application. It should be noted that the detonators discussed herein detonate the explosive sections 40, 42, 44, 26 to deploy the projectiles 12 from the projectile core 16. Prior to detonating the explosive sections as described herein, warhead hull or housing sections (not shown) may be ejected away from the intended travel direction of the projectiles 12 by detonation cords and/or jettison explosive packs (not shown) as disclosed in U.S. Pat. No. 6,598,534, for example, or by other means.

Figure 3:
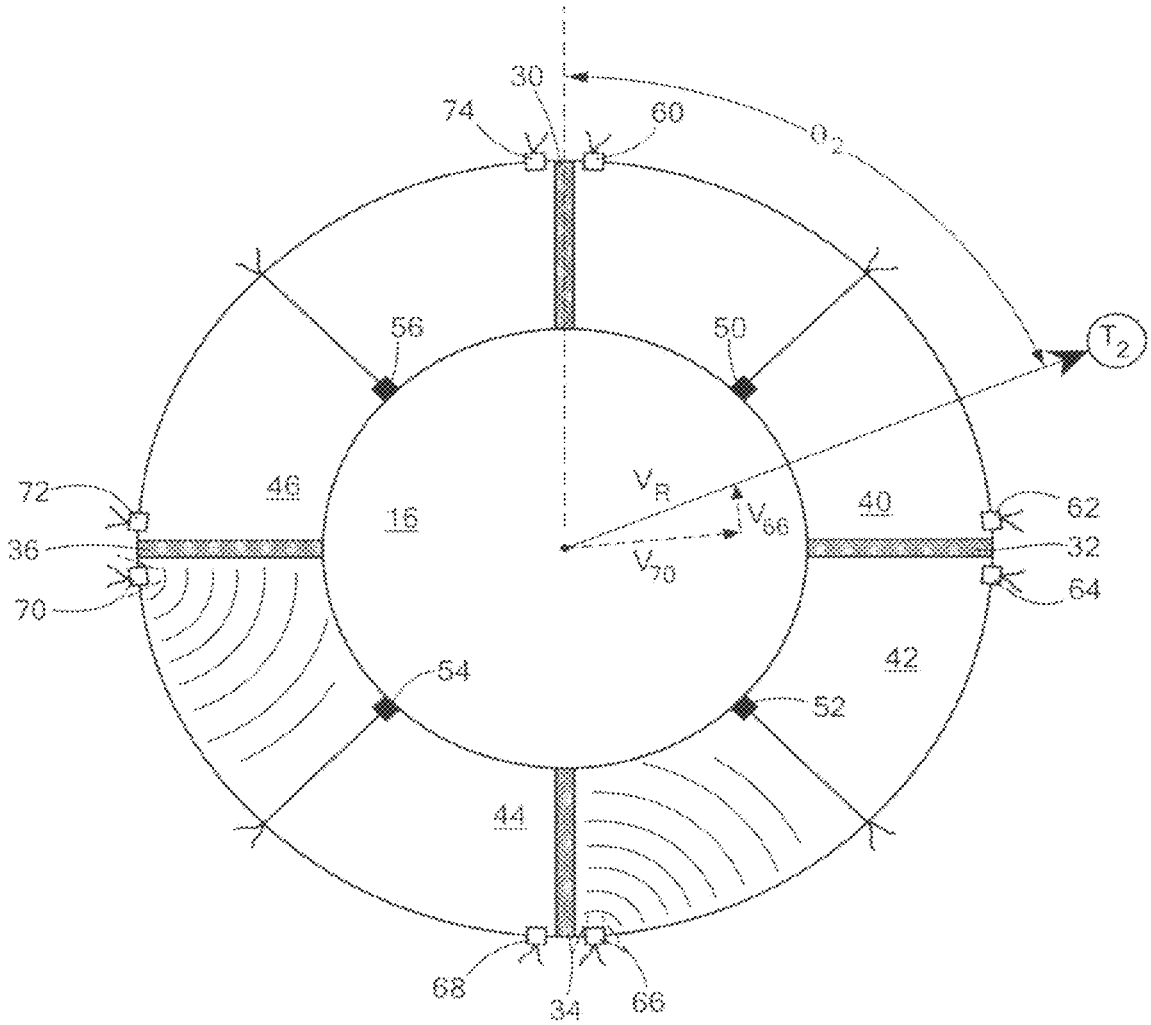
FIG. 3 is a schematic, cross-sectional top view of another kinetic energy rod warhead embodiment in accordance with the present invention.

In FIG. 3 the desired deployment direction is toward $T_2$, located aligned at an angle $\theta_2$. One example combination to achieve the deployment of projectiles from core 16 along a vector $V_R$ is to detonate external or outside detonator 70 then, simultaneously therewith or shortly thereafter (depending on the determination of the exact angle $\theta_2$), detonating external or outside detonator 66. When detonator 70 is fired, explosive section 44 is exploded at an angle, creating a shock wave in segment 44. Detonator 66 also is exploded at an angle, creating a shock wave in explosive segment 42. The pushing forces created by the shock waves result in $V_R$, a resolved vector which is the sum of the vectors $V_{70}$ and $V_{66}$ created by detonation of detonators 70 and 66, respectively, and is the ultimate direction of the center of the deployed plurality of rods or projectiles 12 within core 16.

Figure 4:
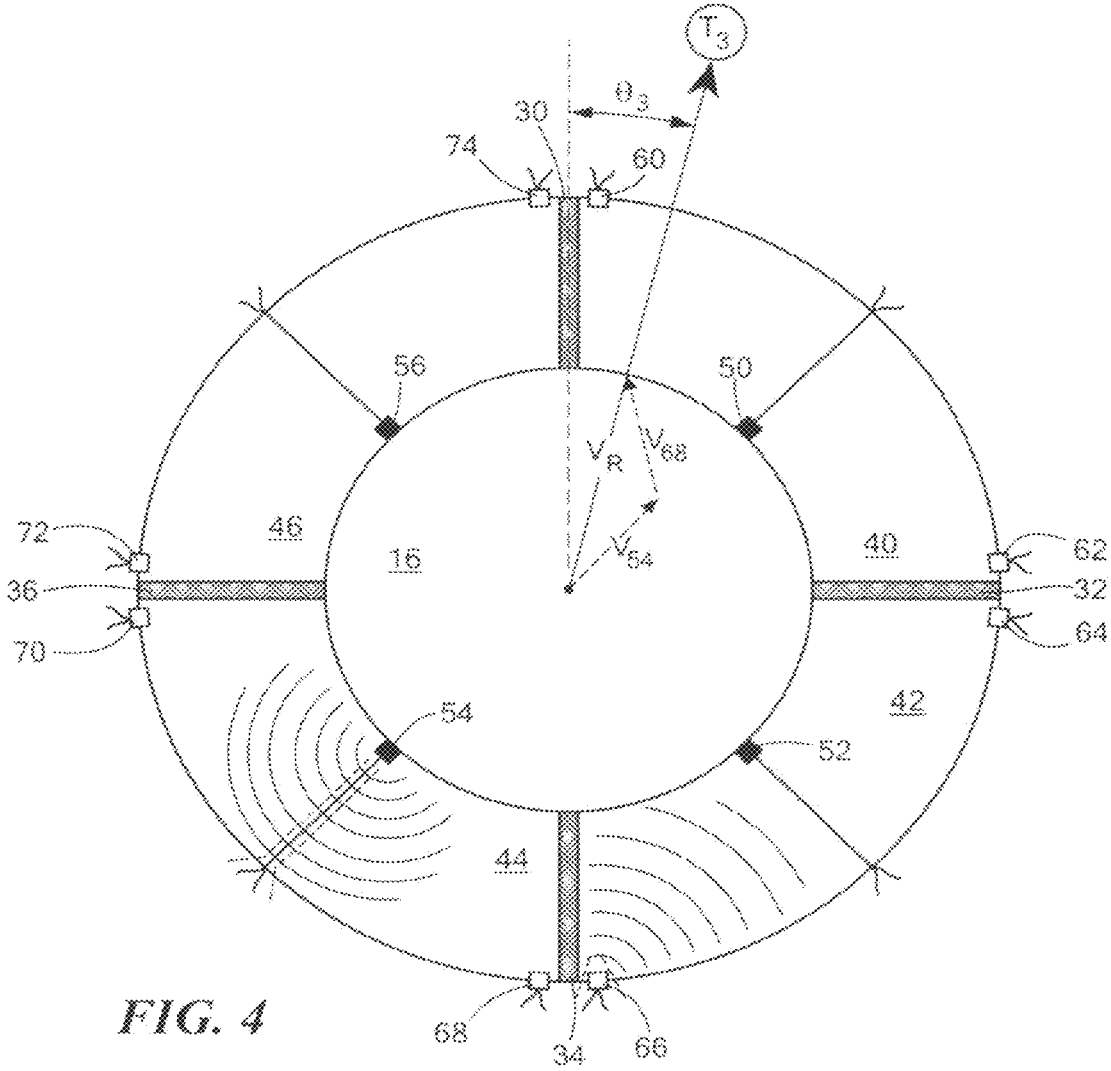
FIG. 4 is a schematic cross-sectional top view of a further embodiment of a kinetic energy rod warhead in accordance with the invention.

If the desired rod deployment direction is toward $T_3$ located aligned at an angle $\theta_3$ as shown in FIG. 4, one example of a combination to achieve the deployment of projectiles from core 16 along a vector $V_R$ is to detonate inside detonator 54 then, simultaneously therewith or shortly thereafter (depending on the determination of the exact angle $\theta_3$), detonating external or outside detonator 66. When internal detonator 54 is fired, section 44 is exploded from the center, creating a shock wave radiating outward. Detonation of external detonator 66 explodes section 42 at an angle, supplying a "pushing" force and biasing the initial shock wave created by internal detonator 54. $V_R$, a resolved vector which is the sum of the vectors $V_{54}$ and $V_{66}$ created by detonation of detonators 54 and 66, respectively, is the ultimate direction of the center of the deployed plurality of rods or projectiles 12 within core 16.

It can be seen and should be understood that the foregoing examples of detonation and firing of explosive sections are not limiting but are set forth for illustration purposes only and in schematic form. The options available for firing of various spaced detonator combinations and the timing thereof is a beneficial and advantageous consequence of the configuration of the invention, including but not limited to the placement of detonators in relation to the explosive segments.

Figure 5:
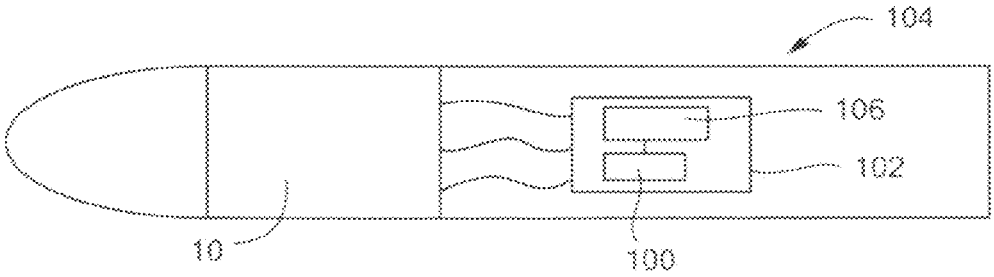
FIG. 5 is a schematic, cross-sectional side view of an embodiment of a controller and target locator system within a carrier for use in accordance with the invention.

In one example, target locator system 100, FIG. 5, is configured to locate a target relative to an isolator. As shown in the examples herein, the angle $\theta$ is measured relative to isolator 30, FIG. 2, although this is not a necessary limitation. It will also be understood that in another variation, a target may be located relative to explosive segments 40, 42, 44 or 46. Target locator systems are known in the art, and are often part of a guidance subsystem such as guidance subsystem 102, FIG. 5. In this example, guidance system 102 is also within carrier or missile 104 and such systems or subsystems commonly include, for example, fusing and/or safe and arm technology using e.g. the distance between the carrier missile and a target static angle (ejection or expulsion angle if the carrier missile were not moving), dynamic angle (the ejection or expulsion angle when the velocity of the carrier is accounted for), and lead angle (angle at which the fuse detects a target in advance), also as known in the art.

Controller 106 is responsive to target locator system 100 and configured to selectively detonate specified detonators or sets of detonators in sequence, depending on the desired deployment direction of plurality of projectiles 12. It should be understood that in various configurations controller 106 may be part of target locator system 100 and/or guidance subsystem 102, any of which may be part of warhead 10 itself as would be known to and understood by those skilled in the art.

The configuration of the kinetic energy rod warhead may vary depending on a particular desired application or result to be achieved, including but not limited to a number of features disclosed in the applicant's other patents and applications. For example, in one embodiment of the invention, projectiles 12, FIG. 1, are lengthy rods, often of cylindrical cross-section and made of metal such as tungsten, and the isolators or sympathetic shields 30, 32, 34 or 36 are made of composite material such as steel sandwiched between polycarbonate resin sheet layers. The rods and sympathetic shields are not necessarily limited to these shapes or materials, and may be of various shapes or materials depending on a desired application. In one variation, each explosive segment 40, 42, 44 and 46 may be wedge-shaped as shown in FIG. 1, where proximal surface 43 abuts projectile core 16 and distal surface 45 is tapered as shown at 47 and 49 to also reduce weight.

As noted and illustrated above, it can be seen that the embodiments of the invention provide for better control of shock waves by allowing for the propagation of a variety of shock waves through the explosive sections, which is more readily achieved by the placement of detonators in accordance with the subject invention. Also, a lesser number of sympathetic shields than were typically used previously results in a greater explosive surface area to build up shock waves and a reduced amount of explosive to interrupt explosive shock waves when explosive segments are detonated. Further as noted, a number of firing options are available with the embodiments of the invention.

Another added benefit is that the rods are typically deployed at a narrower spray angle, that is, the plurality of rods is not as spread out from one another when deployed. This may be an important feature in certain applications and for certain targets.

In addition, the invention also provides advantages when a target is located such that it is more or less aligned with an isolator or the center of an explosive segment.

Figure 6:
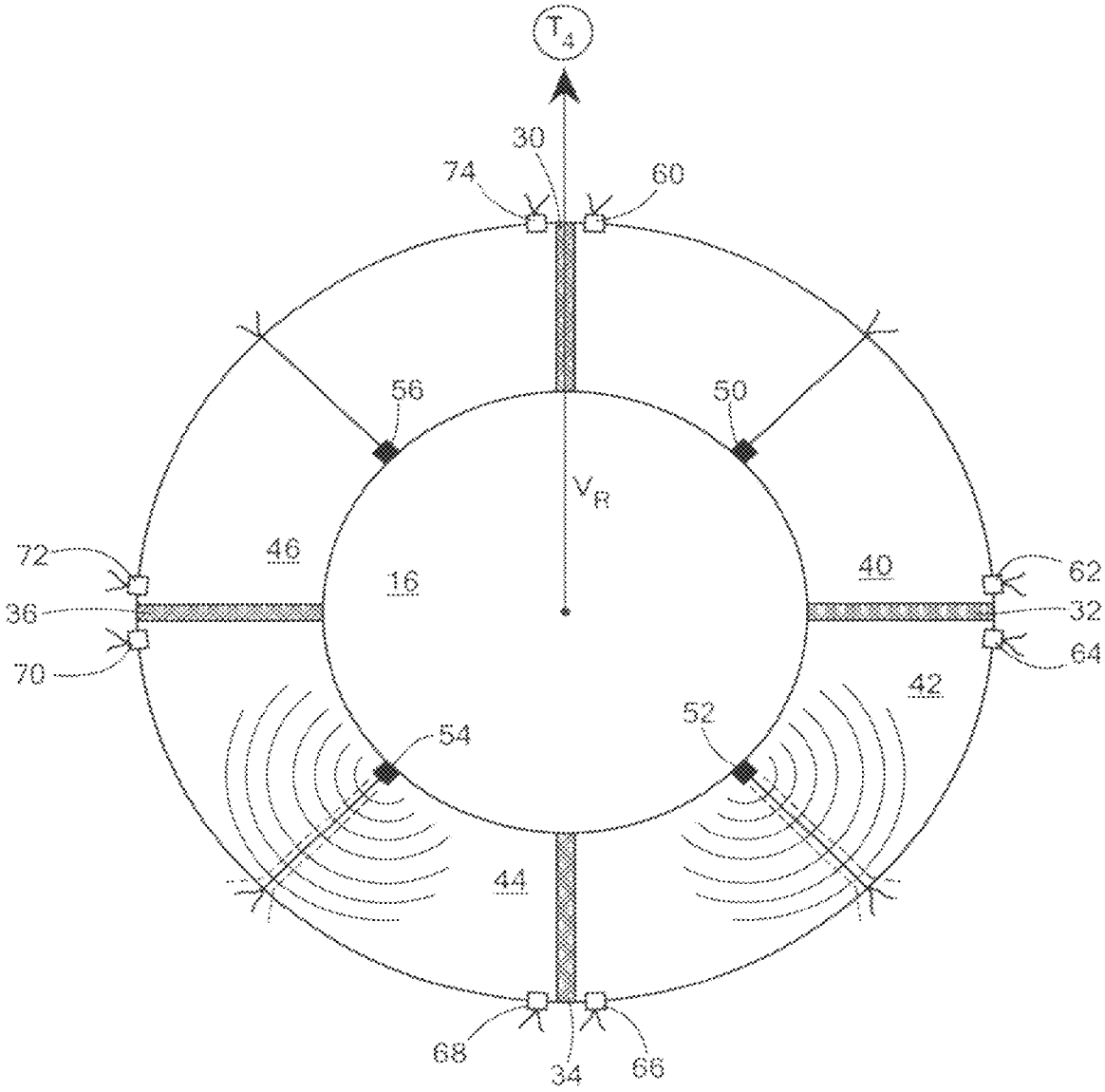
FIGS. 6 and 7 are schematic, cross-sectional top views of still other energy rod warhead embodiments in accordance with the invention.

In one such example, for a target $T_4$, FIG. 6 located aligned with isolator 30 (e.g. a 0° angle), an example combination to achieve deployment of projectiles 12 from core 16 along vector $V_R$ is to deploy internal detonators 52 and 54 simultaneously. $V_R$, a resolved vector which is the sum of the vectors $V_{52}$ and $V_{54}$ created by detonation of detonators 52 and 54, respectively, is the ultimate direction of the center of the deployed plurality of rods or projectiles 12 from core 16. With less explosive sections in accordance with the invention, more explosive force along $V_R$ is provided, capable of deploying the projectiles at a greater velocity towards the target than with a conventional kinetic energy rod warhead.

Figure 7:
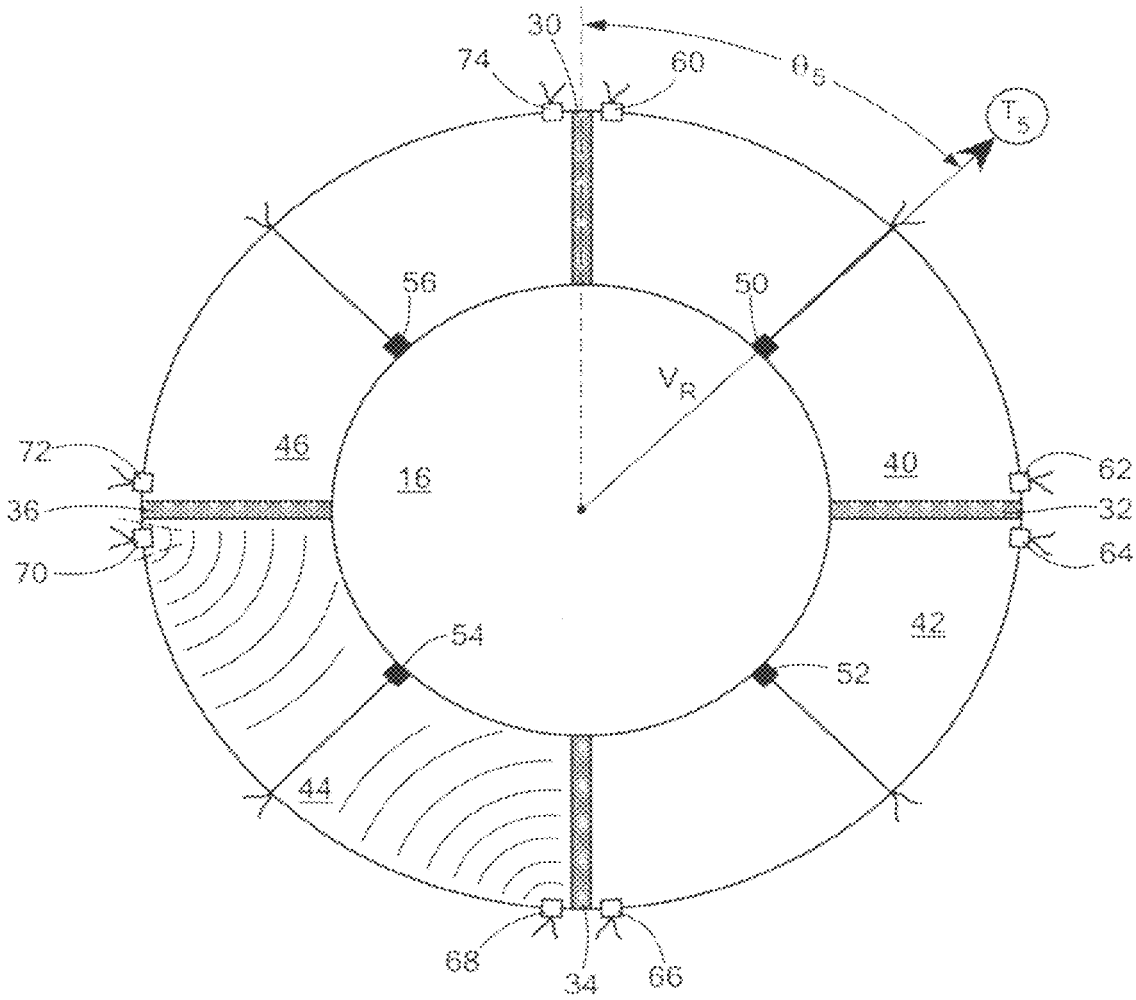

For a target $T_5$, FIG. 7 located aligned with the center of explosive section 40 at angle $\theta_5$ (e.g. a 45° angle), one example which will result in projectiles 12 deployed along vector $V_R$ is to detonate external detonators 68 and 70 simultaneously. $V_R$, a resolved vector which is the sum of the vectors $V_{68}$ and $V_{70}$ resulting from detonation of detonators 68 and 70, respectively, is the ultimate direction of the center of the deployed plurality of rods or projectiles 12 within core 16. In this example, increased explosive force (and consequent increased projectile velocity) is provided not only by the decreased number of sections required to be exploded, but by the increased explosive area and shock waves within explosive section 44 which are not interrupted by isolators or sympathetic shields.

Accordingly, various embodiments of the invention result in an improved kinetic energy rod warhead and system with increased effectiveness which can include more explosive area for explosive shock waves to build, less interruption of explosive shock waves, better control over explosive shock waves, better aiming accuracy, and/or less overall weight which would allow for the addition of more projectiles, for increased lethality.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A kinetic energy rod warhead comprising:
a plurality of projectiles in a projectile core;
explosive segments about the plurality of projectiles;
an isolator between adjacent explosive segments;
an external detonator on an outer surface of each of said explosive segments proximate an isolator;
an internal detonator inside of each explosive segment adjacent said projectile core; and
a controller communicatively connected to the external detonators and to the internal detonators to allow for selective detonation of the internal detonators and the external detonators in a desired and timed sequence.

2. A kinetic energy rod warhead comprising:
a plurality of projectiles in a projectile core;
explosive segments about the plurality of projectiles;
an isolator between adjacent explosive segments;
at least two external detonators on an outer surface of each of said explosive segments proximate an isolator; and
an internal detonator inside of each explosive segment adjacent said projectile core.

3. The kinetic energy rod warhead of claim 1 in which each said isolator includes at least one of the external detonators located on each side thereof.

4. The kinetic energy rod warhead of claim 1 in which the internal detonators are located centrally between two isolators.

5. The kinetic energy rod warhead of claim 1 in which there are at most four explosive segments.

6. The kinetic energy rod warhead of claim 1 in which there are at most four isolators.

7. The kinetic energy rod warhead of claim 1,
further including a target locator system communicatively connected to the controller;
wherein the target locator system locates a target relative to an isolator.

8. The kinetic energy rod warhead of claim 1,
further including a target locator system communicatively connected to the controller;
wherein the target locator system locates a target relative to an explosive segment.

9. The kinetic energy rod warhead of claim 1 in which the projectiles are rods.

10. The kinetic energy rod warhead of claim 9 in which the rods are lengthy metallic members.

11. The kinetic energy rod warhead of claim 10 in which the rods have a cylindrical cross-section.

12. The kinetic energy rod warhead of claim 1 in which the isolators are sympathetic shields.

13. The kinetic energy rod warhead of claim 1 in which the explosive segments are wedge-shaped.

14. The kinetic energy rod warhead of claim 1 including a housing about the explosive segments.

15. A kinetic energy rod warhead comprising:

a plurality of projectile rods in a projectile core;

an explosive surrounding the plurality of projectile rods;

sympathetic shields dividing the explosive into at most four segments;

an internal detonator located centrally inside of each explosive segment adjacent said projectile core;

an external detonator on an outer surface of each of said explosive segments, each said sympathetic shield including at least one said external detonator on each side thereof; and a controller communicatively connected to the external detonators and to the internal detonators to allow for selective detonation of the internal detonators and the external detonators in a desired and timed sequence.

16. A kinetic energy rod warhead comprising:

a plurality of projectiles in a projectile core;

explosive segments about the plurality of projectiles;

an isolator between adjacent explosive segments;

an external detonator on an outer surface of each of said explosive segments proximate an isolator;

an internal detonator inside of each explosive segment adjacent said projectile core; and a target locator system communicatively connected to a controller and configured to locate a target relative to the isolators or the explosive segments;

wherein the controller, responsive to the target locator system, is communicatively connected to the external detonators and to the internal detonators to allow for selective detonation of the internal detonators and the external detonators in a desired and timed sequence.

17. The kinetic energy rod warhead system of claim 16 in which each isolator includes at least one external detonator located on each side thereof.

18. The kinetic energy rod warhead of claim 16 in which the internal detonators are located centrally between two isolators.

19. The kinetic energy rod warhead of claim 16 in which there are at most four explosive segments.

20. The kinetic energy rod warhead of claim 1 including at least two external detonators for each explosive segment.

* * * * *